United States Patent [19]

Suzuki

[11] Patent Number: 4,736,223

[45] Date of Patent: Apr. 5, 1988

[54] COLOR COPYING MACHINE

[75] Inventor: Koji Suzuki, Yokohama, Japan

[73] Assignee: Canon Kabushiki Kaisha, Tokyo, Japan

[21] Appl. No.: 843,085

[22] Filed: May 22, 1986

Related U.S. Application Data

[63] Continuation of Ser. No. 575,689, Jan. 31, 1984, abandoned, which is a continuation of Ser. No. 330,551, Dec. 14, 1981, abandoned.

[30] Foreign Application Priority Data

| | | | |
|---|---|---|---|
| Dec. 16, 1980 | [JP] | Japan | 55-176613 |
| Dec. 16, 1980 | [JP] | Japan | 55-176614 |
| Dec. 19, 1980 | [JP] | Japan | 55-178819 |
| Dec. 19, 1980 | [JP] | Japan | 55-178820 |
| Dec. 19, 1980 | [JP] | Japan | 55-178821 |
| Dec. 19, 1980 | [JP] | Japan | 55-178822 |
| Dec. 19, 1980 | [JP] | Japan | 55-178823 |
| Apr. 22, 1981 | [JP] | Japan | 56-59738 |

[51] Int. Cl.[4] ..... G03G 15/00; G03G 15/01

[52] U.S. Cl. ..... 355/4; 355/3 R; 355/14 R; 355/14 CH

[58] Field of Search ..... 355/3 R, 14 R, 4, 3 CH, 355/300, 140, 14 C; 324/72

[56] References Cited

U.S. PATENT DOCUMENTS

| | | | |
|---|---|---|---|
| 3,815,988 | 6/1974 | McVeigh | 355/3 R |
| 3,852,668 | 12/1974 | Hardenbrook | 324/72 |
| 3,944,354 | 3/1976 | Benwood | 355/3 R |
| 4,213,693 | 7/1980 | Imai | 355/14 D |
| 4,261,660 | 4/1981 | Suzuki | 355/14 R |

*Primary Examiner*—A. C. Prescott

*Attorney, Agent, or Firm*—Fitzpatrick, Cella, Harper & Scinto

[57] ABSTRACT

A color copying machine of the invention has a halogen lamp for emitting light to an original, a photosensitive drum on a surface of which is formed an electrostatic latent image by the light reflected from the original, a transfer section which color-separates the image and transfers it on a paper sheet, a potentiometer probe which detects the surface potential of the photosensitive drum, a microcomputer which makes the measured surface potential to converge to a reference value determined for each color, and a fine tuning board for allowing fine control of the converged value. A copy image of excellent color balance is obtained over a long period of time irrespective of degradation in the units of the machine or variations in the quality of toners. A particular color of the copy image may be emphasized or deemphasized as desired.

21 Claims, 10 Drawing Sheets

| GRAYSCALE RAM ADDRESS |
|---|
| GRAYSCALE 1 |
| GRAYSCALE 2 |
| GRAYSCALE 3 |
| GRAYSCALE 4 |
| GRAYSCALE 5 |
| GRAYSCALE 6 |
| GRAYSCALE 7 |
| GRAYSCALE 8 |
| GRAYSCALE 9 |
| GRAYSCALE 10 |

COLOR COPYING MACHINE

This is a continuation of application Ser. No. 575,689, filed Jan. 31, 1984, which in turn is a continuation of Ser. No. 330,551, filed Dec. 14, 1981.

BACKGROUND OF THE INVENTION

1. Field of the Invention

The present invention relates to a color copying machine and, more particularly, to a color copying machine which is capable of achieving excellent color balance and which is also capable of reproducing a copy image of an original with high precision.

2. Description of the Prior Art

In conventional color copying machines, since the surface potential of a photosensitive body on which an electrostatic latent image is to be formed changes over time, it is difficult to obtain copy images of stable color balance over a long period of time.

This problem will be described briefly with reference to the gradation reproduction characteristics of color copies shown in FIG. 1, wherein Do represents the original image density, Dp represents the printed image density, E is the light exposure, and Vs is the surface potential of the photosensitive body. The first quadrant represents the gradation reproduction characteristics of the gray scale as an original. Curves C, M and Y respectively represent the gradation reproduction characteristics of copy images of cyan, magenta and yellow, and C+M+Y represents the gradation reproduction characteristics of copy images of mixtures of these three colors. The second quadrant (clockwise from the first quadrant) represents the exposure characteristics of Do-E (common logarithm). The third quadrant represents the color separation electrostatic latent image characteristics of red (R), green (G), and blue (B), respectively. The fourth quadrant represents the developing characteristics of images with toners of cyan (C), magenta (M), and yellow (Y), respectively.

The printed image densities Dp of cyan, magenta, and yellow are different from the image densities Do of the same original in the characteristics of the first quadrant, since unnecessary light absorption of the respective toners is corrected to obtain the desired color balance. Since the gray balance is involved as the color balance in this case, unnecessary light absorption of blue and green by the cyan toner, and unnecessary light absorption of blue by the magenta toner are corrected to achieve the desired color balance of an image of the mixture of cyan, magenta and yellow. For this purpose, the color separation electrostatic latent image characteristics of red, green and blue are made substantially the same as shown in the third quadrant, and the developing characteristics of cyan, magenta, and yellow are made different as shown in the fourth quadrant.

In order to obtain a copy image of good color balance, it is necessary to keep the color separation electrostatic latent image characteristics of red, green and blue constant for a long period of time. This is extremely difficult to achieve with conventional color copying machines as described above. The reason for this is attributable to changes in the environment such as temperature and humidity, degradation in the quality of the photosensitive body, and the resultant fluctuations in the electrostatic latent image characteristics. It is also necessary to correct the variations in the developing characteristics of the toners of cyan, magenta and yellow according to the manufacturing lots, and variations in the developing characteristics of these toners which occur over time. Considering this, it has been the general practice to intentionally make the color separation electrostatic image characteristics of red, green and blue as shown in the third quadrant deviate from one another.

However, it is extremely difficult to control the color separation electrostatic latent image characteristics of the respective colors. Specifically, a skilled operator must control the output of the charger of the color copying machine, the light exposure or the like using a surface potentiometer and a recorder. Therefore, the general user is unable to perform this control.

SUMMARY OF THE INVENTION

It is an object of the present invention to provide a color copying machine which eliminates the drawbacks as described above and which produces copy images of excellent color balance.

It is another object of the present invention to provide a color copying machine wherein light reflected by an original after irradiation of the original with light is color-separated, a charged photosensitive body is exposed for each color to form an electrostatic latent image thereon, and the electrostatic latent image is transferred and developed for each color, whereby the surface potential of the photosensitive body is detected, the surface potential is converged to a reference value according to the detection output, and the converged surface potential is controllable.

It is still another object of the present invention to provide a color copying machine wherein, after the surface potential of the photosensitive body corresponding to a predetermined color separation filter is converged to a reference value, a switch is made to another color separation filter so that the surface potential corresponding to this new color separation potential is converged to another reference value.

It is still another object of the present invention to provide a color copying machine wherein the surface potential of the photosensitive body may be converged to different reference values according to the respective separated colors.

It is still another object of the present invention to provide a color copying machine which is capable of displaying the value of the surface potential of the photosensitive body.

It is still another object of the present invention to provide a color copying machine wherein the light exposure during copying is a value obtained by multiplying by a predetermined coefficient the light exposure at the instant of the convergence of the surface potential to a reference value.

The above and other objects and features of the present invention will become apparent from the following description when taken in conjuction with the accompanying drawings.

BRIEF DESCRIPTION OF THE DRAWINGS

FIG. 2-1 is a sectional view of a color copying machine according to the present invention, and FIG. 2-2 is a plan view of a control panel for control of the surface potential of a photosensitive body, according to the present invention;

FIG. 5-1 is a flow chart for control of the surface potential according to the present invention, FIG. 5-2 is a flow chart for display of the surface potential, and FIG. 5-3 is a flow chart for measurement of the gray scale;

FIG. 11 is a view showing a RAM for storing the surface potential of the photosensitive body when the original is the gray scale.

DETAILED DESCRIPTION OF THE PREFERRED EMBODIMENT

Figures 1, 2:
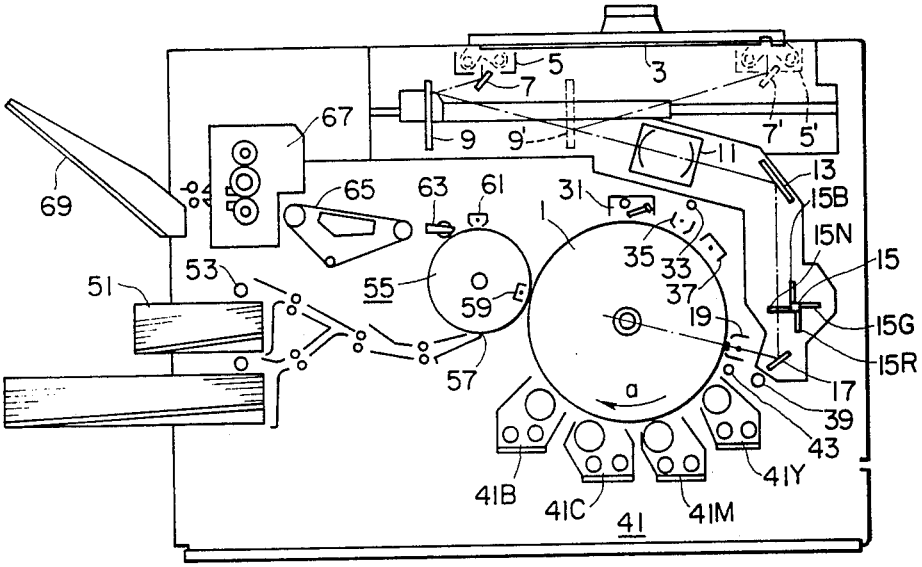

The preferred embodiment of the present invention will now be described in detail with reference to the accompanying drawings. FIG. 2 is a sectional view of a color copying machine according to the present invention. Referring to FIG. 2, a photosensitive body comprising an electrically conductive layer, a CdS photoconductive layer and an insulating layer is formed on the surface of a photosensitive drum 1 rotating in the direction indicated by arrow a. An original to be copied is placed on an original glass table 3 and is illuminated by light emitted by a lamp 5. Scanning mirrors 7 and 9 scan the original in synchronism with the rotation of the photosensitive drum 1, and are displaced to the positions indicated by 7' and 9' while at the same time the lamp 5 is displaced to the position indicated by 5'. The light reflected by the original becomes incident through a lens 11, a mirror 13, a color separator 15, a mirror 17, and a secondary charger 19 for simultaneous exposure and charge removal on the surface of the photosensitive body of the photosensitive drum 1 to form an electrostatic latent image. The color separator 15 comprises, according to the colors to be color-separated, a blue filter 15B, a green filter 15G, a red filter 15R, and an ND filter 15N. The color separator 15 switches these filters by rotary movement for performing color separation.

The surface of the photosensitive body of the photosensitive drum 1 is cleaned by a blade cleaner 31 in advance, and the effects of the preceding exposure operation is removed by a preexposure lamp 33 and a precharge remover 35. The surface of the photosensitive body is then uniformly charged by a primary charger 37 to maintain the surface of the photosensitive body at a uniform potential. The charge on the surface of the photosensitive drum is then removed by the secondary charger 19 together with the image of the original, and then the surface is uniformly exposed by an overall exposure lamp 39 to form an electrostatic latent image of high contrast thereon. The intensity of the electrostatic latent image, that is the electrostatic potential, is detected by a potentiometer probe 43 which is interposed between the overall exposure lamp 39 and a developing unit 41 to be close to the surface of the photosensitive drum 1.

The developing unit 41 comprises a yellow developing unit 41Y, a magenta developing unit 41M, a cyan developing unit 41C, and a black developing unit 41B, to which toners of respective colors are supplied for developing. A transfer paper sheet 51 held in a cassette is fed to a transfer section 55 by a pickup roller 53. A gripper 57 grips the leading end of the transfer paper sheet 51 at the transfer section 55. The electrostatic latent image on the surface of the photosensitive body of the photosensitive drum 1 is transferred by corona discharge to the gripped transfer paper sheet 51 from the rear surface thereof by a transfer corona discharger 59. In the case of monochromatic copying, after charge removal by a separation charge remover 61, the transfer paper sheet 51 is immediately separated from the transfer section 55 by a separation pawl 63. In the case of color copying, the gripper 57 of the transfer section 55 is not released and the separation pawl 63 is not operated so that the transfer paper sheet 51 is gripped until the transfer of the two or three toners of different colors is completed. After the completion of the transfer, the separation pawl 63 is operated to separate the transfer paper sheet 51 from the transfer section 55, and the transfer paper sheet 51 is fed to a heating roller fixer 67 for fixing of the image through a feed belt 65. After fixing, the transfer paper sheet 51 is exhausted to a tray 69. After transfer, the toner (or toners) remaining on the surface of the photosensitive drum 1 is (or are) cleaned by the blade cleaner 31 for the next copying cycle.

Figure 1:
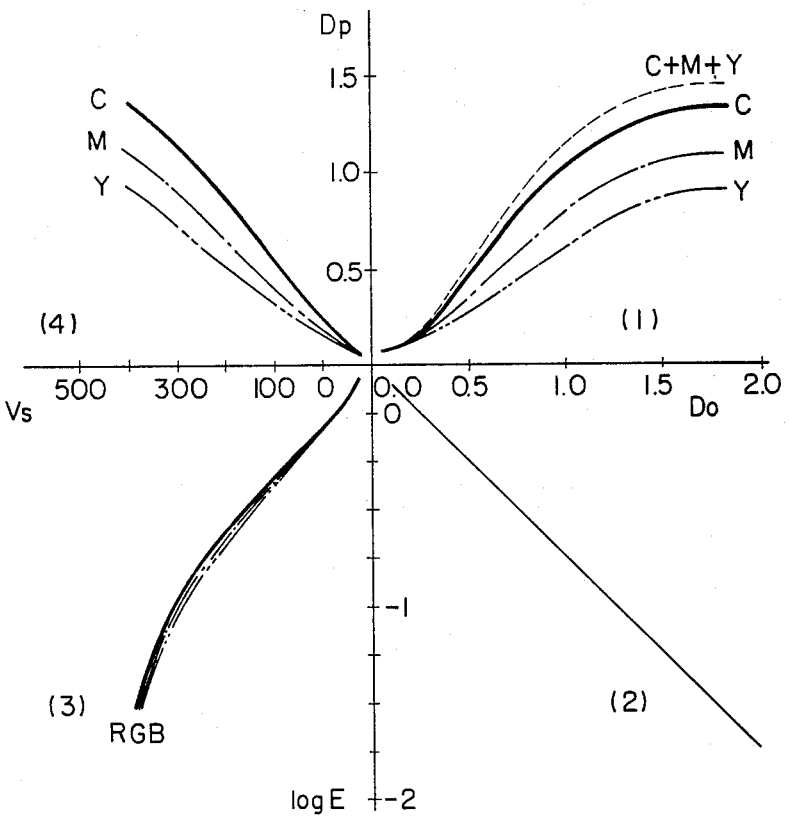
FIG. 1 is a graph showing the gradation characteristics of color copying.
Figure 4:
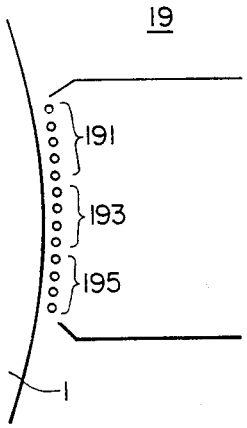
FIG. 4 is a schematic view of a secondary charger.
Figure 2:
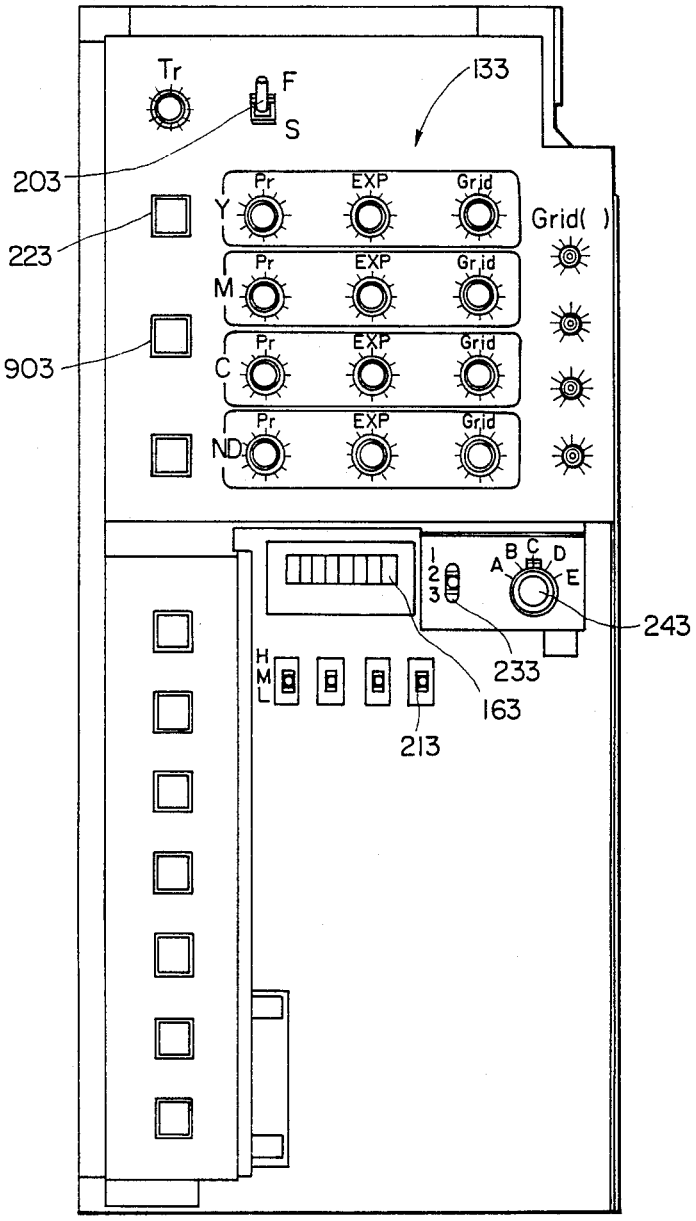

FIG. 4 is a schematic sectional view of the secondary charger 19 shown in FIG. 2-1. As shown in FIG. 4, groups of wires are embedded at the opening of the charger 19 at the side of the photosensitive drum 1. These groups of wires are a negative grid 191, a zero grid 193, and a positive grid 195. The bias voltages applied to these grids are −50 to −300 V, 0 V (ground potential), and +50 to +200 V for the negative grid 191, the zero grid 193 and the positive grid 195, respectively.

FIG. 2-2 is a plan view of a control panel for controlling the surface potential of the photosensitive drum. When a potential setting mode changeover switch 203 is changed over to the side of a contact F, a reference potential setting mode is established. When this potential setting mode changeover switch 203 is changed over to the S side, a potential setting mode is established which combines the reference potential setting with fine control by a fine tuning board 133 to be described later. The fine tuning board 133 has control knobs for varying the primary charging voltage, the firing voltage of the halogen lamp, the voltages to be applied to the grids 191 and 195 in correspondence with the respective colors of yellow, magenta, cyan, and black. With a changeover lever 213, it is possible to set the surface potential of the photosensitive body in three different stages. A display 163 displays the value of the surface potential. A switch 223 is for performing the measurement of the surface potential. A switch 233 for switching the display of the display 163 displays the surface potential of the photosensitive body with reference to the gray scale when it is set to 1, displays measurement data ($V_{SL}$, $V_D$, $V_{WL}$, and so on) stored in the RAM as will be described later when it is set to 2, and displays control value data ($V_2$, $I_1$, $V_G$., and so on) stored in the RAM. A switch 243 is for switching the color to be displayed or the pattern of the gray scale according to the display mode set by the switch 233. A switch 903 is for performing the measurement of the potential of the photosensitive body with reference to the gray scale.

The color balance of the color copy image will now be described. Assume that the image densities (color filter densities) of cyan, magenta and yellow are different from one another as shown in the first quadrant of FIG. 1. The image density of magenta must be intermediate those of cyan and yellow. The image densities of cyan and yellow must be considered taking the image density of magenta as an intermediate value.

For achieving the color balance, the image density ratio of cyan to magenta is within the range of 1.5:1 to 1:1, preferably, about 1.2:1. The image density ratio of magenta to yellow is within the range of 1:0.9 to 1:0.6, preferably about 1:1. For example, when the maximum image density of magenta is 1.2, the preferable maximum image density of cyan is 1.44 and the tolerance is 1.8 to 1.32 to achieve the desired color balance. The maximum image density is 0.96 and the tolerance is 1.08 to 0.72. In this manner, the image density of cyan has a greater tolerance from the intermediate value toward higher values, and the image density of yellow has a greater tolerance from the intermediate value toward lower values. Therefore, even if the initial developing characteristics are ideal as shown in the fourth quadrant in FIG. 1, it is convenient to slightly deviate the reference values of the potentials of the surface of the photosensitive body set for each color separation exposure so that the reference value for red > the reference value for green > the reference value for blue, considering the subsequent fluctuations in the developing characteristics. For example, the potential (dark part potential) $V_D$ of the unexposed part of the electrostatic latent image is about 380 V for red, green and blue. By changing it to 400 V for red, 380 V for green and 360 V for blue, the adverse effects of the fluctuations in the developing characteristics, imprecision in the automatic control of the surface potential and so on may be effectively eliminated.

According to the embodiment of the present invention, the surface potential of the photosensitive drum may be set in three different stages by the changeover lever 213, and the reference values $V_{DO}$, $V_{WLO}$, and $V_{SLO}$ for the dark part (when lamp 5 is off) during polychromatic copying, the intermediate density part (when lamp 5 is lit by a voltage of intermediate value), and the bright part (when lamp 5 is lit by the maximum rated voltage) respectively are set as shown in Table 1 below:

TABLE 1

| | $V_{DO}$ (V) | $V_{WLO}$ (V) | $V_{SLO}$ (V) | |
|---|---|---|---|---|
| Red | 500 | 100 | −120 | (1) |
| Green | 470 | 85 | −120 | |
| Blue | 450 | 75 | −120 | |
| Red | 400 | 20 | −120 | (2) |
| Green | 380 | 15 | −120 | |
| Blue | 360 | 10 | −120 | |
| Red | 320 | −10 | −120 | (3) |
| Green | 310 | −15 | −120 | |
| Blue | 300 | −15 | −120 | |

Figure 3:
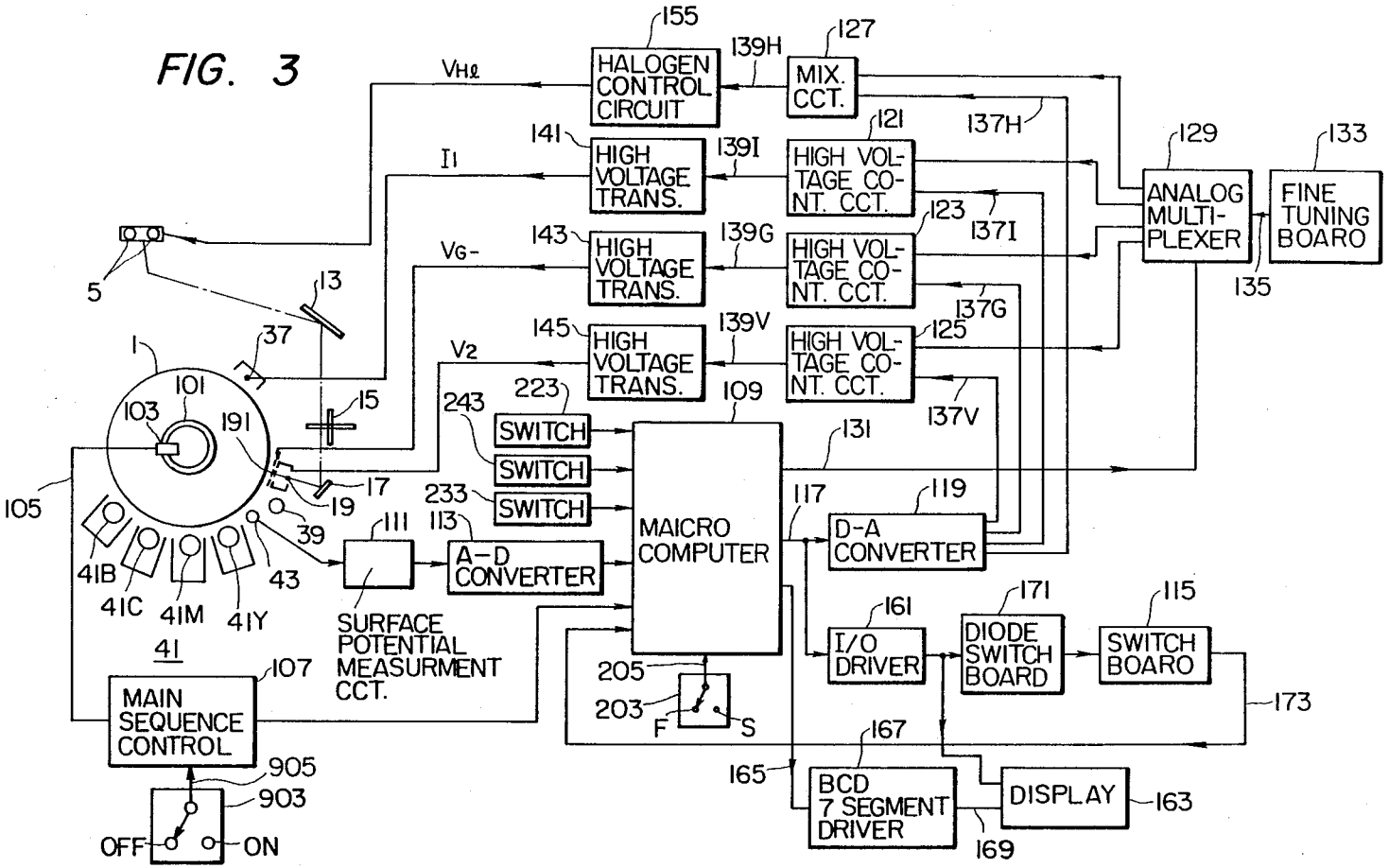
FIG. 3 is a block diagram of control circuitry of the color copying machine according to the present invention.

FIG. 3 is a block diagram showing an example of control circuitry for controlling the surface potential of the photosensitive body. Referring to FIG. 3, drum clock pulses 105 are output from a photointerruptor 103, in accordance with the rotational angle of the photosensitive drum 1 which is detected by a chopper disk 101. These drum clock pulses 105 are counted by a main sequence controller 107 of the color copying machine for control of each unit of the color copying machine. The main sequence controller 107 supplies, to a microcomputer 109 for controlling the surface potential, timing signals for switching the high voltage or the light quantity of the halogen lamp, and timing signals for measuring the dark part potential $V_D$, the intermediate density part potential $V_{WL}$, and the bright part potential $V_{SL}$. The potential of the electrostatic latent image detected by the surface potential potentiometer probe 43 is detected by a surface potential measurement circuit 111 as a potential of 1/300 of the surface potential, is converted to a digital signal by an A-D converter 113, and is supplied to the microcomputer 109. The microcomputer 109 calculates according to a control equations so that the measured potential may converge to the reference value selected by a switch board 115. A signal representing the calculation result is supplied to a D-A converter 119 through a bus line 117 for conversion into an analog signal. The analog signals thus obtained are supplied to high voltage control circuits 121, 123 and 125 and to a mix circuit 127. In response to a control signal 131 supplied from the microcomputer 109, an analog multiplexer 129 sequentially supplies an image fine control signal 135 from the fine tuning board 133 to the high voltage control circuits 121, 123 and 125 and the mix circuit 127. The analog signals 137I, 137G and 137V are added to the image fine control signal 135 by the high voltage control circuits 121, 123 and 125 to produce a sum voltage signal 139I, 139G or 139V. After being boosted by a high voltage transformer 141, 143 or 145, the sum voltage signal 139I, 139G or 139V is supplied to the primary charger 37, the negative grid 191 of the secondary charger 19, or the secondary charger 19. In response to the sum voltage signal 139I, 139G or 139V, the primary charging current $I_1$, the negative grid voltage $V_{G-}$, or the secondary charging voltage $V_2$ is controlled, respectively. When the image fine control signal 135 is supplied to the mix circuit 127, a mix signal 139H obtained by mixing the analog signal 137H with the image fine control signal 135 is supplied to a halogen control circuit 155 to control a halogen voltage $V_H$l to be supplied to the (halogen) lamp 5. The microcomputer 109 supplies through the bus line 117 a digital signal to an I/O driver 161. The I/O driver 161 specifies the bit number of a BCD 7 segment display 163 of 8 bits. In response to a display signal 165 from the microcomputer 109, a BCD 7 segment driver 167 produces an output signal 169 to the display 163 which then displays the surface potential of the photosensitive drum. A diode switch board 171 is scanned through the I/O driver 161 to sequentially select the reference values set at the switch board 115. The voltage signals of the reference values selected in this manner are supplied to the microcomputer 109 which calculates according to individual control equations to be described later and operates to converge the voltage signals to the reference values. The voltage signals converged to the reference values by the microcomputer 109 are converted to analog signals by the D-A converter 119. The analog signals thus obtained are supplied to the high voltage circuits 121, 123 and 125, and the mix circuit 127, respectively.

The control sequence of the control circuitry shown in FIG. 3 will now be described. Before operating the color copying machine of the present invention, the operator performs the following. First, the operator places a blank paper sheet (transfer paper sheet) on the original glass table 3, and sets the diaphragm of the copying machine at "5" (reference value). Next, the operator sets the reference value by the changeover lever 213 (connected to the switch board 115) mounted externally to the color copying machine. After these operations, the operator depresses the switch 223 and then turns on a copy key (not shown) to energize the control circuitry. The control operation of the control circuitry is performed according to the flow chart shown in FIG. 5-1.

A voltage control switch of the control circuitry is turned on (step 401). The unnecessary charge on the surface of the photosensitive drum 1 is removed by the forward rotation of the photosensitive drum 1 (step 403). Under this condition, the lamp 5 is lit with the voltage $V_{Hl}$ as the maximum rated voltage to make the light quantity of the lamp 5 maximum. The filters of the color separator 15 are so set that the light reflected from the original at the maximum light quantity is transmitted through the ND filter 15N of the color separator 15. The photosensitive drum 1 is rotated once to expose the surface of the photosensitive drum 1 to the light reflected from the original. The bright part potential $V_{SL}$ at the surface of the photosensitive body of the photosensitive drum 1 is detected by the potentiometer probe 43. A detection signal from the potentiometer probe 43 is supplied to the surface potential measurement circuit 111 to measure the bright part potential $V_{SL}$ (step 405). It is discriminated if the difference $|V_{SL}-V_{SLO}|$ between the bright part potential $V_{SL}$ and the reference value $V_{SLO}$ of the bright part potential is within a tolerance C1 (step 407). If the discrimination result is NO, the secondary charging voltage $V_2$ of the charger 19 is controlled according to a control equation $\Delta V_2=\delta\Delta V_{SL}$ (step 409). The flow returns to step 405 and the same operation is repeated. The operations of steps 405, 407, and 409 are repeated until the bright part potential $V_{SL}$ obtained by the secondary charging voltage $V_2$ controlled in step 409 is below the tolerance $C_1$. If it becomes below the tolerance $C_1$ and the discrimination result of YES is obtained in step 407, the color separator 15 is rotated so that the blue filter 15B is set to transmit the light from the original (step 411). In step 411, the filters are switched in the order of green, red, ND, green, and red filters. The lamp 5 is turned off, and the photosensitive drum 1 is rotated once without exposure of the original. Since the surface potential of the photosensitive body of the photosensitive drum 1 is at the dark part potential $V_D$, the dark part potential $V_D$ is detected by the potentiometer probe 43 (step 413). It is then discriminated if the difference between the measured dark part potential $V_D$ and the reference value $V_{DO}$ is below a tolerance $C_2$ (step 415). If the discrimination result is NO, the primary charging current $I_1$ of the primary charger 37 is controlled according to the control equation $\Delta I_1=\alpha\Delta V_D$ (step 417). The flow then returns to step 413, and the same operation is repeated. When the dark part potential $V_D$ converges to the reference value $V_{DO}$ within the tolerance $C_2$, the discrimination result of YES is obtained in step 415. Then, the flow goes out of the loop.

The lamp 5 is lit at the maximum rated voltage, and the light exposure of the original is made maximum. The photosensitive drum 1 is rotated to expose the surface of the photosensitive body with the maximum light quantity. Under this condition, the bright part potential $V_{SL}$ as the surface potential is detected by the potentiometer probe 43 (step 419). It is discriminated in step 421 if the difference $|V_{SL}-V_{SLO}|$ between the measured bright part potential $V_{SL}$ and the reference value $V_{SLO}$ is below a tolerance $C_3$. If the discrimination result is NO, the negative grid voltage $V_{G-}$ of the negative grid 191 of the secondary charger 19 is controlled according to the control equation $\Delta V_{G-}=\beta_1\Delta V_D+\beta_2\Delta V_{SL}$ (step 423). The flow returns to step 419 to repeat the operation within the loop. If the bright part potential $V_{SL}$ converges to the reference value $V_{SLO}$ below the tolerance $C_3$, the discrimination result of YES is obtained in step 421 and the flow goes out of the loop.

The lamp 5 is lit by the halogen voltage $V_H$ which is an intermediate voltage which is used to achieve the reference light exposure. Under this condition, the photosensitive drum 1 is rotated to expose the surface of the photosensitive body. Then, the surface potential of the photosensitive body becomes the intermediate density part potential $V_{WL}$. This intermediate density part potential $V_{WL}$ is detected by the potentiometer probe 43 (step 425). It is then discriminated in step 427 if the difference $|V_{WL}-V_{WLO}|$ between the detected intermediate density part potential $V_{WL}$ and the reference value is less than tolerance $C_4$. If the discrimination result is NO, the halogen voltage $V_{Hl}$ for firing the lamp 5 is controlled according to the control equation $\Delta V_{Hl}==\gamma\Delta V_{WL}$ (step 429). Then, the flow returns to step 425, and the loop operation is repeated. If the intermmediate density potential $V_{WL}$ converges to the reference value $V_{WLO}$ within the tolerance $C_4$, the discrimination result of YES is obtained in step 427 and the flow goes out of the loop. In this manner, in steps 411 to 427, the primary charging current $I_1$ at the blue filter 15B, the negative grid $V_{G-}$, and the halogen voltage $V_{Hl}$ are controlled. It is then discriminated in step 431 if the filter set in the color separator 15 is the final one. Since the discrimination result of NO is obtained in this case, the flow returns to step 411. In step 411, the color separator 15 is rotated in the order of blue, green, red, ND, green and red to switch and set the filter. Every time the filter is set, the operations of steps 413 to 429 are performed to control the primary charging current $I_1$, the negative grid voltage $V_{G-}$, and the halogen voltge $V_{Hl}$ for the set filter. The loop operation thus described is repeated. When the control of the respective voltages is completed for the final filter, the discrimination result of YES is obtained in step 431, and the control operation of the control circuitry is completed. In this manner, the voltages are set so that the surface potentials are determined at the predetermined values for trichromatic copying of blue, green and red, monochromatic copying of black and white, and dichromatic copying of magenta and black. Under the voltages controlled in this manner, the image of the original set on the original glass table 3 is copied on the transfer copy sheet 51.

It is preferable to externally mount a changeover switch so that a selection may be made by a stroke operation of this changeover switch among trichromatic copying of blue, green and red, monochromatic copying of black and white, and dichromatic copying of magenta and black. In the case of this embodiment, as shown in Table 1 above, the changeover may be made in three stages. The surface potentials converge to the reference values thus determined.

Figures 1, 5:
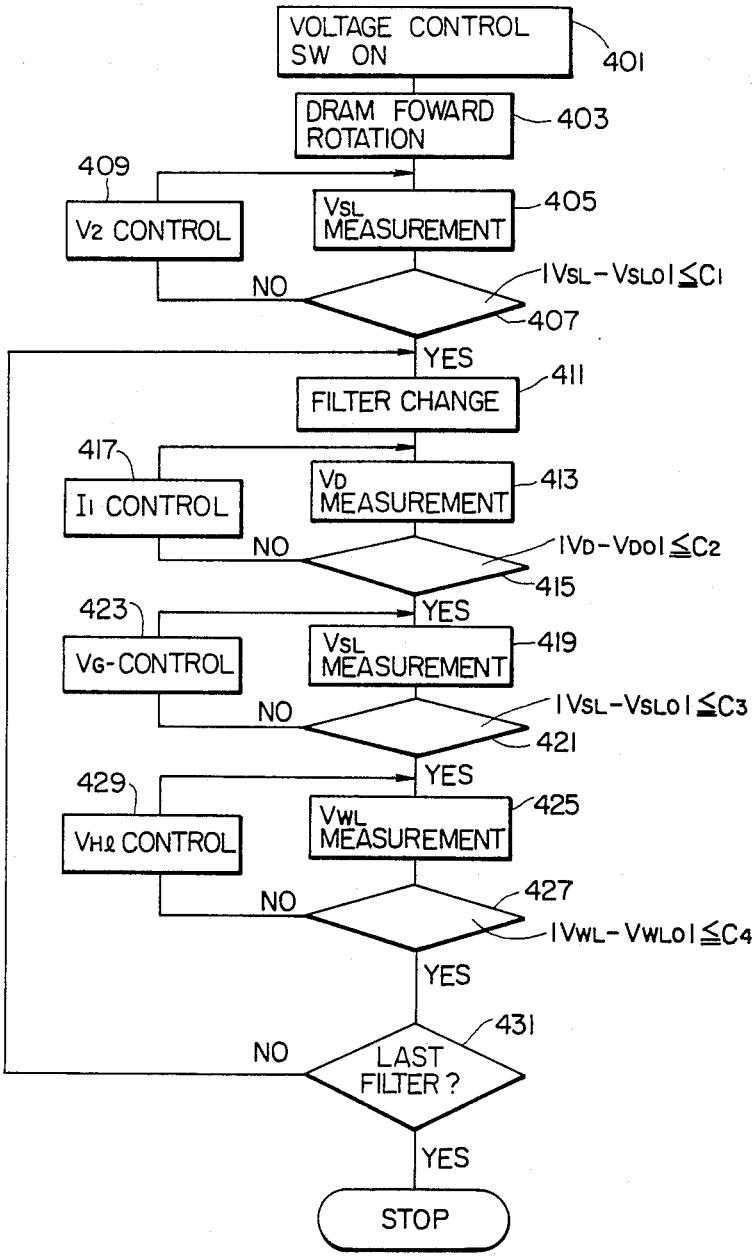
Figures 2, 5:
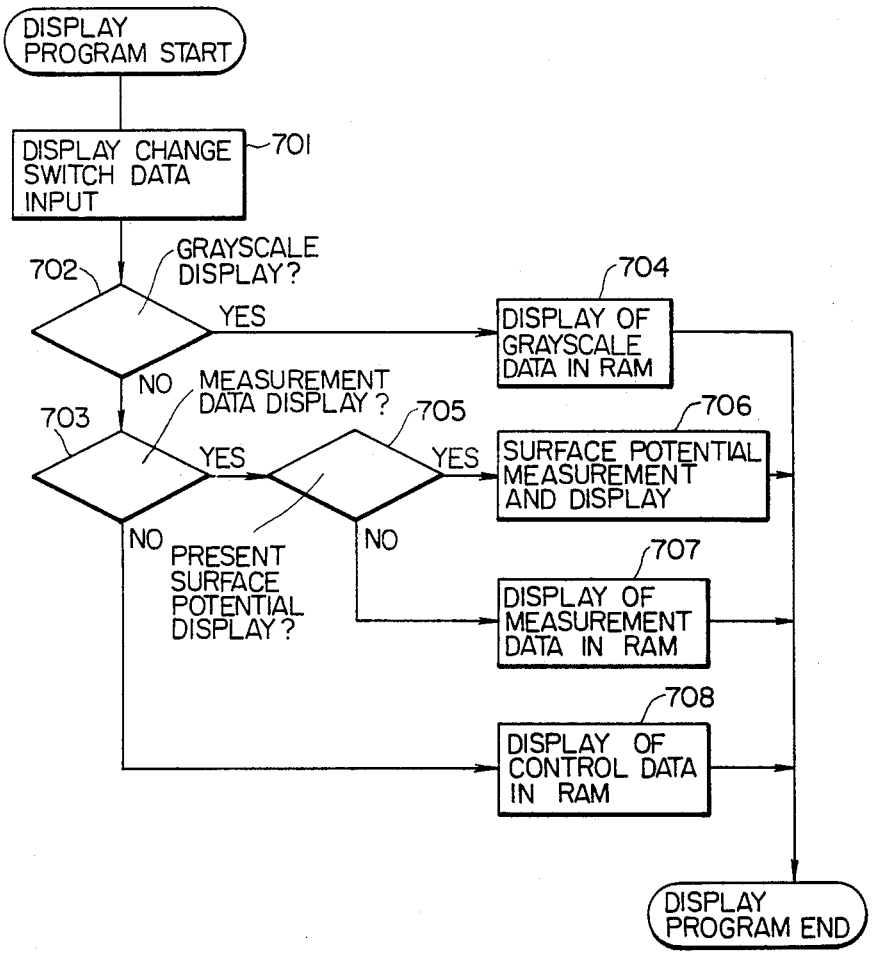

The measurement of the bright part potential $V_{SL}$ and the intermediate density part potential $V_{WL}$ in steps 405, 419 and 425 is performed after the surface potential is established by scanning the original at the same speed as in the copying operation while the transfer sheet paper is placed on the original glass table 3. The coefficients $\gamma$, $\delta$, $\alpha$, $\beta_1$, and $\beta_2$ in the respective control equations shown in FIG. 5-1 represent gradients of the functions of each equation.

The reason why the secondary charging voltage $V_2$ is controlled prior to the control of the negative grid voltage $V_{G-}$ of the secondary charger 19 as shown in the flow chart in FIG. 5-1 will be explained with reference to the configuration of the secondary charger 19 shown in FIG. 4. The distance between the wires of the grids 191 to 195 and the surface of the photosensitive drum 1 is generally 1.0±0.1 mm. Within this tolerance of the distance, the bright part potential $V_{SL}$ fluctuates within the range of −120±30 V, if the discharge wire voltage of the secondary charger 19 is −8.5 kV, and the voltages applied to the grids 191, 193 and 195 are −120 V, 0 V and 100 V, respectively. Therefore, in order to cancel the variations among the units and to obtain a constant bright part potential $V_{SL}$ with constant grid voltage, the secondary charging voltage $V_2$ is first controlled. Thereafter, the negative grid voltage $V_{G-}$ is applied to the negative grid 191 to control the bright part potential $V_{SL}$ according to the gradation control method described in the specification of Japanese Laid-Open Patent Application No. 14237/79, "Electrographic Method and Apparatus" of the same applicant.

As has been described earlier, the reference values to be set by the switch board 115 are set in a stepped manner (three stages in the embodiment described above). Therefore, it is not possible to set the voltage intermediate the predetermined stages. In order to allow this, the fine tuning board 133 is incorporated. The fine tuning board 133 has control volumes in correspondence with trichromatic copying in blue, green and red and monochromatic copying of black and white, these control volumes being operative in cooperation with the control knobs mounted outside the copying machine. The voltage signal, the image fine control signal 135, obtained from these control volumes of the fine tuning board 133, controls the output from one of the high voltage control circuits 121 to 125 or the mix circuit 127, in accordance with the switching operation of the analog multiplexer 129. In response to this image fine control signal 135, the halogen voltage $V_{Hl}$, the primary charging current $I_1$, the negative grid voltage $V_{G-}$, the secondary charging voltage $V_2$, and the positive grid voltage (the voltage applied to the positive grid 195 shown in FIG. 4, the applying and control system for this voltage being not shown) are controlled. The control of the potential by adding the fine control components to the reference values is also performed according to the flow chart shown in FIG. 5-1. The reference values of the bright part potential $V_{SL}$, the intermediate density part potential $V_{WL}$, and the dark part potential $V_{DO}$ are set at the switch board 115. When the image fine control signal 135 is supplied to the high voltage control circuit 125 from the analog multiplexer 129, the operations of steps 405, 407 and 409 in FIG. 5-1 are executed. When the image fine control signal 135 is next supplied to the high voltage control circuit 123, the operations of steps 413, 415 and 417 are executed. When the image fine control signal 135 is supplied to the high voltage control circuit 121, the operations of steps 419, 421 and 423 are executed. When the image fine control signal 135 is supplied to the mix circuit 127, the operations of steps 425, 427 and 429 are executed. In this manner, the secondary charging voltage $V_2$, the primary charging current $I_1$, the negative grid $V_{G-}$, and the halogen voltage $V_{Hl}$ are set to establish the surface potential which is the sum of the reference value and the fine control components. In this manner, the voltages may be similarly set by controlling the control volumes of the fine tuning board 133, even if the voltages must be set between the reference values. Since the operation shown in FIG. 5-1 is performed for each color involved, fine control may be performed for each color. Therefore, copying of images with emphasis on desired colors may be obtained for individual originals.

Referring back to FIG. 3-1, if the potential setting mode changeover switch 203 is switched to the side of the contact F to establish the automatic mode, the surface potential is automatically set to the reference value.

When the potential setting mode changeover switch 203 is switched to the side of a contact S, the mode selection signal 205 is supplied to the microcomputer 109 to set the potential control circuitry under the semi-automatic control mode. In this mode, the voltages are set at the reference values ($V_{DO}$, $V_{WLO}$, $V_{SLO}$) which are set in a stepped manner at the switch board 115, according to the flow chart shown in FIG. 5-1. However, the automatic control involving the fine control components is not performed. Then, the control signal 131 is supplied to the analog multiplexer 129, and the image fine control signal 135 representing the voltage manually set at the control volume of the fine tuning board 133 is sequentially supplied to the high voltage control circuit 121 to 125 and the mix circuit 127. Then, the voltages $V_{G-}$, $V_2$, $V_{Hl}$, and current $I_1$ are determined according to the sums of the analog signals 137I, 137G, 137V and 137H, and the image fine control signal 135.

If the original is placed on the original glass table 3 and copying is performed, a color image of excellent color balance is obtained on the transfer paper sheet. Particular colors may be emphasized or deemphasized according to the taste. Especially in the semi-automatic mode, the particular colors may be emphasized or deemphasized during copying even during the copying operation by controlling with the fine control volume.

A description will now be made with reference to FIGS. 4 and 5-1 again. The microcomputer 109 commands the display 163 to display the reference values $V_{DO}$, $V_{WLO}$ and $V_{SLO}$ corresponding to the desired surface potential and the potentials $V_D$, $V_{WL}$, and $V_{SL}$ converging to these reference values, during the control. For example, during the execution of the operations of steps 405 to 409, the bright part potential $V_{SL}$ is displayed at the display 163. During the execution of the operations of steps 413 to 417, the dark part potential $V_D$ is displayed at the display 163. Therefore, the surface potential after automatic control may be conveniently checked. Furthermore, by observation of the converging condition of the surface potential to the surface values, the degradation of the photosensitive body may be assessed. If a memory is incorporated to store the potentials after the convergence, this data may be read out from the memory and displayed at the display 163 even after the potential control, so that preceding set values of the surface potentials may be easily known later.

Alternatively, it is also possible to use the reference density sheet to measure the surface potentials and to display the measured surface potentials.

Figure 8:
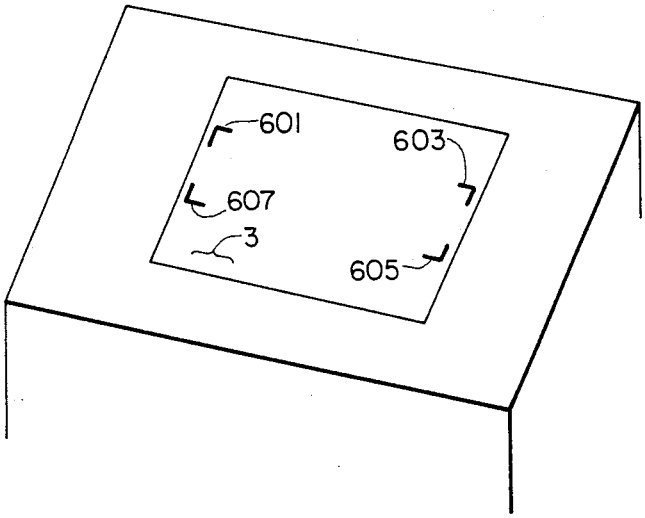
FIG. 8 is a perspective view of an original table.
Figure 9:
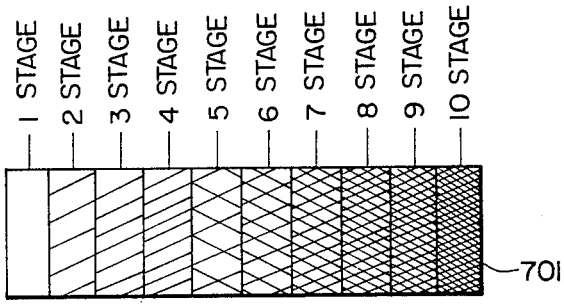
FIG. 9 is a view showing a reference density sheet.
Figure 10:
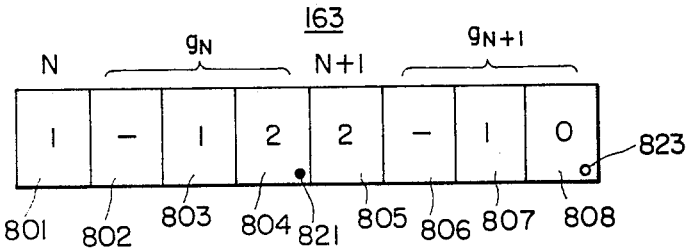
FIG. 10 is a view showing an example of display of the surface potential.

FIG. 8 shows reference density sheet mounting marks 601, 603, 605 and 607 on the original glass table 3. When measuring with the gray scale, the operator places a reference density sheet 701 shown in FIG. 9 within the area surrounded by the marks 601 to 607. A potential setting mode changeover switch 903 shown in FIG. 3 is switched to the side of ON to supply a mode selection signal 905 to the main sequence controller 107. The main sequence controller 107 produces a command to start the normal sequence for the copying operation. However, the developing unit 41 and the pickup roller 53 are not energized. Then, an electrostatic latent image of the reference density sheet 701 having the densities in 10 stages under the reference light exposure of the lamp 5 is formed on the surface of the photosensitive body of the photosensitive drum 1. The main sequence controller 107 then supplies a timing pulse to the microcomputer 109 to rotate the photosensitive drum 1 once and to detect the potentials of the electrostatic latent images corresponding to the boundaries of the stages of the gray scale by the potentiometer probe 43. The detected potentials are displayed at the display 163 as shown in FIG. 10. Display elements 801 to 804 and 805 to 808 display potentials for two stages of the gray scale. The display element 801 displays the ordinal number N of a given stage, and the display elements 802 to 804 display the potential gN of this stage. The display element 805 displays the ordinal number N+1 of the next stage, and the display elements 806 to 808 display the potential gN+1 of this next stage. Dot display elements 821 and 823 respectively display 0 when the lamp 5 is lit and 5 when the lamp 5 is not lit.

In the example shown in FIG. 10, the potential gN is −120 V and the potential gN+1 is −105 V. By detecting the potential of the electrostatic latent image of a desired stage, the potential may be finely read in ten stages from the bright part to the dark part. Although it is finely read in ten stages from the bright part potential $V_{SL}$, the intermediate density part potential $V_{WL}$, and the dark part potential $V_D$, it is also possible to correctly read the potential between these three potentials. Therefore, it is possible to obtain correct electrostatic latent image characteristics, which is convenient for measuring the developing characteristics of the toners. It is also possible to check the potential after the automatic control of the surface potential, to monitor the degradation in the quality iof the photosensitive body, and to counter-measure other troubles. After checking the potentials using the reference density sheet 701, the potential setting mode changeover switch 903 is switched to the side of OFF to establish the normal mode.

Control of the display of the surface potential will be described with reference to FIGS. 5-2 and 5-3. In step 701, data from the switches 233 and 243 is input. Based on the input data, it is discriminated in steps 702 and 703, whether the data to be displayed is the display data of the gray scale or the measured values. If it is discriminated in step 702 that the switch 233 is set to "1" and the gray scale display mode is selected, the data stored in the RAM is sequentially read out according to the flow chart shown in FIG. 5-3 to be described later in step 704, and the readout data is displayed at the display 163.

If, on the other hand, it is discriminated in step 703 that the switch 233 is set to "2" and the measured data display mode is selected, it is then discriminated in step 705 if the display is the present surface potential. If the switch 243 is set to E, the present surface potential is displayed in step 706. If the switch 233 is set to one of A, B, C and D, the measured data corresponding to one of the B, G, R and ND filters stored in the RAM is displayed in step 707.

If it is discriminated in step 703 that the switch 233 is set to "3" and the control data display mode is selected, the control data stored in the RAM is read out and displayed in step 708.

Figures 3, 5, 11:
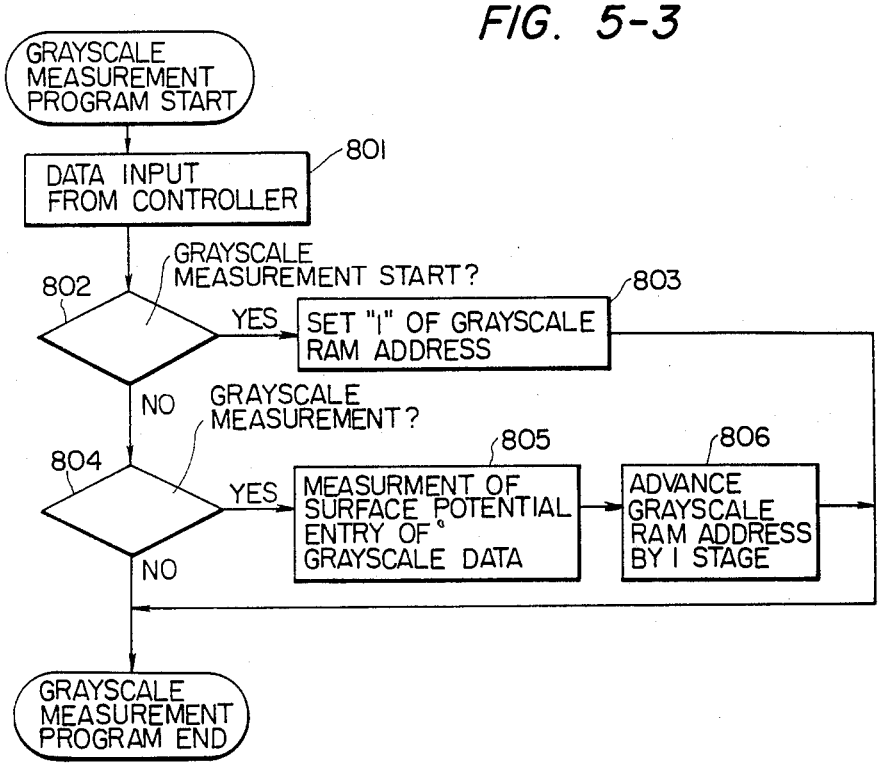

The flow chart of the gray scale measurement program shown in FIG. 5-3 will now be described. In step 801, data on whether the switch 253 is on or not is input from the main sequence controller 107. When the measurement of the gray scale is initiated in step 802, the address of the RAM to store the data shown in FIG. 11 is set to "1" in step 803. The surface potentials at respective parts of the gray scale are measured in steps 804 to 806. The measurement data is stored in the predetermined address of the RAM, and the address of the RAM is advanced by one stage.

The control for determining the halogen voltage $V_{Hl}$ executed in steps 425, 427 and 429 will now be described with reference to FIG. 6.

Figure 6:
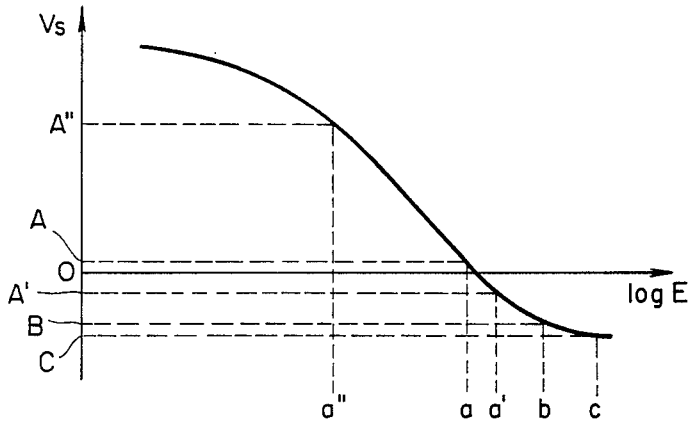
FIG. 6 is a graph showing the characteristics of the light exposure of a halogen lamp and the surface potential.

FIG. 6 shows the relationship between log E (logarithm of the light exposure) and $V_S$ (surface potential), the converged value of the surface potential of the photosensitive body by the control of the halogen lamp voltage.

In FIG. 6, the intermediate density part potential $V_{WL}$ as the reference point of the control of the halogen lamp voltage is indicated by A, which is obtained by placing a blank paper sheet on the original glass table, illuminating the blank paper sheet by light emitted by the lamp, and the surface potential of the photosensitive body is converged to potential A while controlling the corona discharge voltage or current, or the grid voltage of the corona discharger. The lamp voltage and the light exposure at this instance are indicated by Va and a (log E=a), respectively.

The potential indicated by B is obtained with a light exposure b (log E=b) when the blank paper sheet on the original glass table is illuminated by the lamp applied with a lamp voltage Vb which is obtained by multiplying the potential Va by a predetermined coefficient. The original is illuminated while this lamp voltage Vb is applied in actual copying operation. The potential indicated by C is a saturated value of the bright part potential $V_{SL}$, which is obtained by firing the lamp at the maximum voltage below the rated value. This potential corresponds to the potential below that required for setting the secondary charging condition.

The reason why the surface potential indicated by A in FIG. 6 is selected as the reference value of the lamp voltage is for controlling the potential with the good linear relationship between log E and $V_S$ and for improving the control accuracy. Therefore, it is preferable that the potential A is within the range indicated by A′ to A″ in which the linear relationship between the surface potential and the light exposure may be good.

If the control of the lamp voltage is performed with reference to the potential B, the control accuracy is decreased. If the control of the lamp voltage is performed with the saturated potential C, practical control becomes difficult.

In the color copying machine shown in FIG. 2, if the light exposure obtained with an original having a reflecting density of 0.10 is represented by b (log E=b), the potential A is obtained with the light exposure a (log E=a) where b−a=0.30. It is to be noted that b−a′≈0.2 and b−a″≈1.2. Therefore, the light exposure a is half the exposure b.

When controlling the lamp voltage, the reference reflecting sheet on the original table, that is the transfer paper sheet, is illuminated by the lamp to which is applied the lamp voltage $Va_{(1)}$ stored as the initial value in the microcomputer 109 shown in FIG. 3. If the electrostatic latent image potential obtained deviates from the potential A, the lamp voltage $Va_{(n)}$ (where n=1, 2, 3, . . . ) is corrected so that the electrostatic latent image potential converges to the potential A. If the lamp voltage obtained when the lamp voltage converges to the potential A is multiplied by a predetermined coefficient, the lamp voltage Vb to be applied to the lamp during actual copying is determined.

The predetermined coefficient described above may be obtained in the manner to be described below. If the light exposure a is doubled, the light exposure b for actual copying is obtained. Since the flux of light is approximately proportional to 3.36 powers of the lamp voltage ratio Vb/Va (with a halogen lamp having the color temperature of 3,000° K.), Vb/Va is obtained as 1.23 from $\log (Vb/Va)^{3.36}=0.30$. Thus, the voltage Vb need be a value obtained by multiplying the voltage Va by 1.23.

For example, when the halogen lamp of 160 V and 3,000° K. is used, Vb=148 V if Va=120 V. During the actual copying operation, copy images without fog may be obtained when this voltage Vb=148 V is applied to the lamp.

The above description is made for the sake of simplicity in the case wherein the exposure is made with white light, and the density of the reference reflecting sheet is 0.10 which is the same as the density of the original. In order to properly control the color-separated electrostatic latent images of R, G and B, the color temperature of the halogen lamp and the color density of the reference reflecting sheet must be considered.

As has been described above, in the case of white light, the flux of light is proportional to 3.36 powers of the lamp voltage ratio. However, this proportionality changes depending upon the spectrum characteristics of the optical system including the B, G and R filters, mirrors, and lenses; thus, this index must be experimentally determined.

With the color copying machine shown in FIG. 3, the respective indices for the B, G and R filters were 3.58, 3.35, and 2.83.

As ffor the color density of the reference reflecting sheet, when the transfer paper sheet was used as the reference reflecting sheet, the densities of the B, G and R filters for the transfer paper sheet were 0.11, 0.10 and 0.08. Substantially the same results were obtained when the reference reflecting sheet was another wood free paper sheet, Kent paper sheet, a coated paper sheet, a ZnO paper sheet. Similar color density was also obtained with most of the blank parts of the originals.

Lamp voltage correction coefficients $F_B$, $F_G$ and $F_R$ for B, G and R may be obtained as follows from the indices of B, G and R of the halogen lamp and the color densities of B, G and R of the reference reflecting sheet:

$$F_B;\ \log (Vb/Vb)^{3.58} = 0.30 + (0.11 - 0.11^*) = 0.29$$
$$Vb/Va = 12.1 \qquad F_B = 1.21$$
$$F_G;\ \log (Vb/Va)^{3.35} = 0.30 + (0.10 - 0.10^*) = 0.30$$
$$Vb/Va = 1.23 \qquad F_G = 1.23$$
$$F_R;\ \log (Vb/Va)^{2.83} = 0.30 + (0.10 - 0.08^*) = 0.32$$
$$Vb/Va = 1.30 \qquad F_R = 1.30$$

The terms in parenthesis indicated by asterisks are included for correction of the deviations of the measurements of the color densities from the color densities described above when the color densities of B, G and R of the reference reflecting sheet are assumed to be 0.10.

Thus, the lamp voltage correction coefficients $F_B$, $F_G$ and $F_R$ hold the relation $F_B \leqq F_G \leqq F_R$ when a blank paper sheet or a reflecting sheet close to a blank paper sheet is used as the reference reflecting sheet.

The color separation electrostatic latent image characteristics of B, G and R are made uniform and copy images of excellent color balance may be obtained when the above relation is satisfied.

Figure 7:
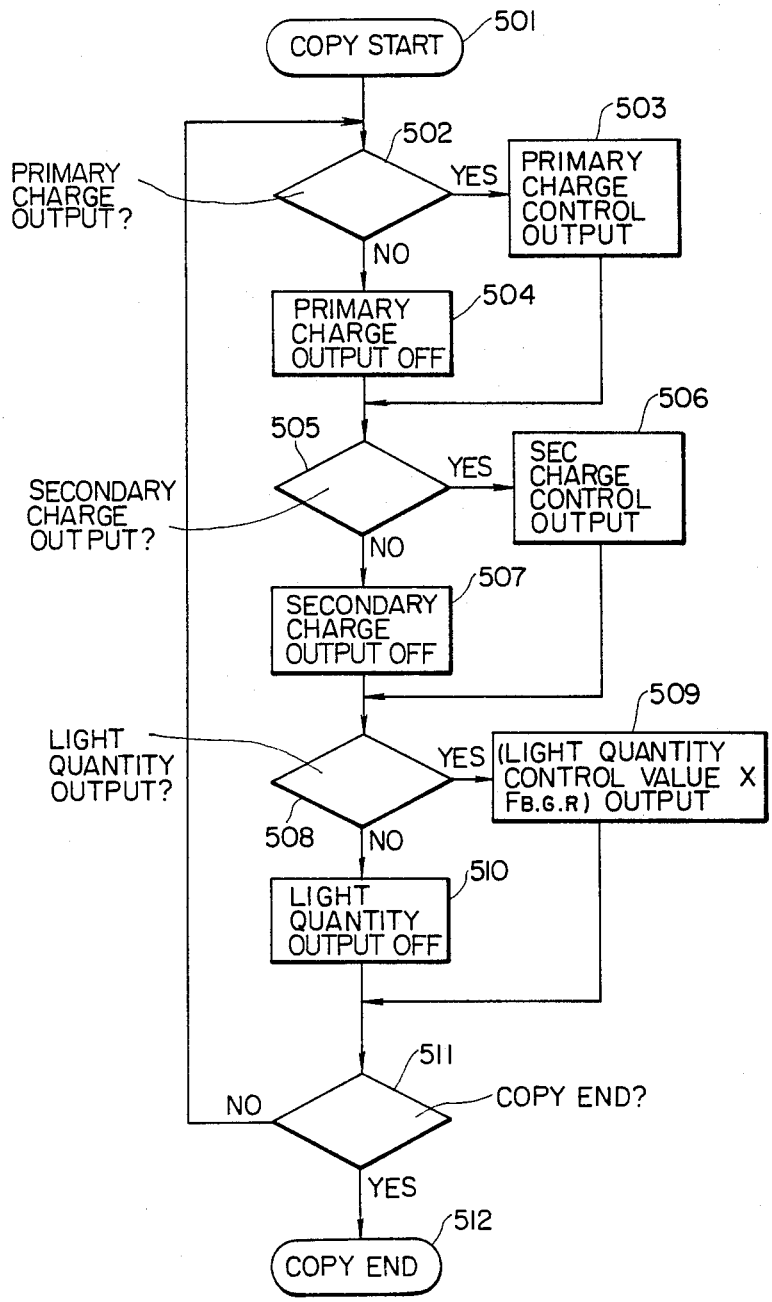
FIG. 7 is a flow chart of control during copying.

The image control is performed according to the flow chart shown in FIG. 7 during the actual copying by the secondary charging voltage $V_2$, the primary charging current $I_1$, the negative grid voltage $V_{G-}$, and the halogen voltage $V_{Hl}$.

Referring to the flow chart of FIG. 7, copying is initiated in step 501, and whether or not the primary charging output is to be output is discriminated in step 502. If the primary charging output is to be output, the primary charging control value described above is output in step 503. If the primary charging output is not to be output, the primary charging output is turned off in step 504. The same operations are executed for the secondary charging output in steps 505 to 507, and whether or not the light quantity output is to be output is discriminated in step 508. If the light quantity is discriminated to be output, the light exposure (light quantity control value$\times F_B$, $F_G$ and $F_R$) for each color is output in step 509. For example, assume that $F_B=1.21$, $F_G=1.23$ and $F_R=1.30$ as described above. If the light quantity is discriminated not to be output in step 508, the light quality output is turned off in step 510. Subsequently, the copy end is discriminated in step 511. If the discrimination result is NO, the steps following step 502 are repeated. If the discrimination result obtained in step 511 is YES, the copying operation is terminated.

If the reference reflecting sheet used in the present invention is of relatively dark gray (e.g., the reflecting density is 0.4 or higher), there is the problem of obtaining the constant density, the problem of higher manufaturing cost, and the problem of consumption of more power by the lamp, in comparison with the case wherein a blank paper sheet is used. Therefore, the color densities of B, G and R of the reference reflecting sheet are preferably 0.3 or below, more preferably about 0.1.

Examples of the controlled potentials according to the present invention will be shown in Tables 2 and 3 below. $V_{DO}$, $V_{WLO}$ and $V_{SLO}$ of Table 2 are obtained according to the potential setting of (2) shown in Table 1.

TABLE 2

| | $V_{DO}$ (V) | $V_{WLO}$ (V) | $V_{SLO}$ (V) | $V_{2(1)}$ (KV) | $I_{1(1)}$ (μA) | $V_{G-(1)}$ (V) | $V_{a(1)}$ (V) |
|---|---|---|---|---|---|---|---|
| Red | 400 | 20 | −120 | −8.5 | 200 | −140 | 100 |
| Green | 380 | 15 | −120 | −8.5 | 190 | −130 | 98 |
| Blue | 360 | 10 | −120 | −8.5 | 175 | −120 | 110 |

TABLE 3

| | $V_D$ (V) | $V_{WL}$ (V) | $V_{SL}$ (V) | $V_2$ (KV) | $I_1$ (μA) | $V_{G-}$ (V) | $V_a$ (V) | $V_b$ (V) |
|---|---|---|---|---|---|---|---|---|
| Red | 395 | 20 | −120 | −8.7 | 200 | −140 | 150 | 137 |
| Green | 380 | 15 | −120 | −8.7 | 195 | −140 | 95 | 117 |

TABLE 3-continued

| | $V_D$ (V) | $V_{WL}$ (V) | $V_{SL}$ (V) | $V_2$ (KV) | $I_1$ (μA) | $V_{G-}$ (V) | $V_a$ (V) | $V_b$ (V) |
|---|---|---|---|---|---|---|---|---|
| Blue | 370 | 15 | −115 | −8.7 | 185 | −130 | 115 | 139 |

In Table 2, $V_{2(1)}$ is the initial high voltage of the secondary charger. $I_{1(1)}$ is the initial high current of the primary charger, $V_{G-(1)}$ is the initial value of the grid voltage of the secondary charger, and $V_{a(1)}$ is the initial value of the lamp for obtaining $V_{WLO}$. Table 3 shows the control values after the potential control.

In this manner, by setting the surface potential of the photosensitive body of the photositive drum 1 according to the respective color separation exposures while the transfer paper sheet is placed on the original glass table 3, excellent color balance is established. When the original to be copied is then placed on the original glass table 3 and the copying operation is performed, the copy image of excellent color balance is obtained on the transfer paper sheet 51. Furthermore, since the surface potential is set for each color, the contrast of the copy image may be freely changed. If it is desired to emphasize or deemphasize a particular color, it is easily achieved by changing the potential of the color-separated electrostatic latent image of this color. If the developing characteristics of the toners change, the setting value of the surface potential for each color may be varied by changing the reference value. Therefore, free and responsive control may be attained.

In summary, according to the present invention, a color copying machine is provided wherein excellent color balance of the copy image is attained and checking of the surface potential is possible. Since the surface potential may be freely set, changes in various characteristics of the units of the machine or the toners may be cancelled, and the copy image with a desired color emphasized or deemphasized may be obtained. Fine control of the color balance may be possible during the copying operation as well. Control of the surface potential may be achieved in a short period of time.

What is claimed is:

1. A color image forming apparatus comprising:

image forming means for forming a color image on a recording medium;

control means for controlling said image forming means to form a plurality of different density patterns on said recording medium; and detecting means for sequentially detecting the value of a surface condition of said recording medium in accordance with said density patterns;

storage means for storing the values of the surface condition of said recording medium which are detected by said detecting means;

display means for displaying the values of the surface condition stored in said storage means; and selecting means for manually selecting any one of the values of the surface condition to be displayed on said display means in accordance with said plurality of different density patterns.

2. A color image forming apparatus according to claim 1, wherein said displaying means displays surface potentials corresponding to a plurality of parts of the original.

3. A color image forming apparatus according to claim 2, wherein the original is a reflecting sheet having a reference density pattern.

4. A color image forming apparatus according to claim 3, wherein said displaying means continuously displays the surface potential of said recording medium corresponding to the reference density pattern.

5. A color image forming apparatus comprising:

image forming means for forming a color image on a recording medium;

detecting means for detecting the value of a surface condition of said recording medium; and controlling means for controlling the value of the surface condition for each color in response to a detection signal from said detecting means, wherein said detecting means detects the value of the surface condition of a sample area formed on said recording medium with a common sample for each color, and said control means controls said image forming means in accordance with the detection signal from said detecting means and a different control parameter for each color for varying an operation condition of said image forming means for each color to regulate an image forming condition for each color.

6. A color image forming apparatus according to claim 5, wherein the surface condition is a surface potential.

7. A color image forming apparatus comprising:

image forming means for forming a color image on a recording medium;

determining means for determining the respective color data concerning a control of said image forming means before a color image formation, upon varying an operation condition of said image forming means for each color, to regulate an image forming condition of said image forming means for each color;

storage means for storing, during the color image formation, the data for plural colors obtained from said determining means; and control means for controlling said image forming means to form the color image on the recording medium in accordance with the data for each other stored in said storage means after the control data for all of the plural colors are determined by said determining means.

8. A color image forming apparatus according to claim 7, wherein said image forming means resolves reflected light from an original for every color, forms a latent image on a photosensitive medium, develops the latent image for every color, and transfers the developed image to the recording medium.

9. A color image forming apparatus according to claim 8, wherein said determining means causes a surface condition on said photosensitive medium to converge on a predetermined value.

10. A color image forming apparatus according to claim 9, wherein said surface condition is a surface potential on said photosensitive medium.

11. A color image forming apparatus according to claim 7, wherein said plurality of colors are red, green and blue.

12. A color image forming apparatus according to claim 7, wherein said control means controls said image forming means in accordance with the data, for each color, stored in said storage means, after each color image formation is completed.

13. A color image processing apparatus comprising:

image processing means including light means for exposing a document;

detecting means for detecting an image forming condition obtained from irradiation of a reference sample common for each color by said light means; and control means for controlling said image processing means in accordance with control data for each color, wherein said control data are obtained by means of an arithmetic operation of output values from said detecting means according to each color using a different operational parameter for each color for varying an operation condition of said processing means for each color to regulate an image forming condition for each color.

14. An apparatus according to claim 13, wherein a density of said reference sample is a density according to a recording medium.

15. An apparatus according to claim 13, wherein said control means controls a turn on voltage of said light means based on said control data.

16. A color image forming apparatus comprising:

image forming means for forming a color image on a recording medium, said image forming means having a platen for receiving thereon an original;

detecting means for detecting an image forming condition according to reflection from the plane of said platen; and control means for controlling said image forming means in accordance with control data for each color, wherein said control data are obtained by means of an arithmetic operation of output values from said detecting means for each color using a different operational parameter for each color for varying an operation condition of said image forming means for each color to regulate an image forming condition for each color.

17. An apparatus according to claim 16, wherein said image forming means has exposing means for exposing the original, and said control mans controls said exposing means based on said control data.

18. An apparatus according to claim 17, wherein said control data is a turn on voltage of said exposing means.

19. An apparatus according to claim 16, wherein said detecting means detects the image forming condition according to reflection from a white sheet disposed on said platen.

20. An apparatus according to claim 19, wherein said image forming condition is a surface condition of said recording medium.

21. An apparatus according to claim 20, wherein said surface condition is a surface potential.

* * * * *

UNITED STATES PATENT AND TRADEMARK OFFICE

CERTIFICATE OF CORRECTION

PATENT NO. : 4,736,223

DATED : April 5, 1988

INVENTOR(S) : KOJI SUZUKI, ET AL.

It is certified that error appears in the above-identified patent and that said Letters Patent is hereby corrected as shown below:

IN [75] INTRO.

"Inventor: Koji Suzuki, Yokohama, Japan" should read --Inventors: Koji Suzuki, Yokohama; Yutaka Komiya, Tokyo; Kouki Kuroda, Tokyo; Jyohi Nagahira, Tokoyo; Takao Aoki, Abiko, all of Japan--.

SHEET 4

FIG 3, "BOARO" should read (both occurrences) --BOARD-- and "MAICRO COMPUTER" should read --MICRO COMPUTER--.

COLUMN 2

Line 58, "conjuction" should read --conjunction--.

COLUMN 6

Line 15, "equations" should read --equation--.

COLUMN 8

Line 26, "$\Delta V_{HI} == y\Delta V_{WL}$" should read --$\Delta V_{HI} = y\Delta V_{WL}$--.

Line 28, "termmediate" should read --termediate--.

Line 43, "voltge $V_{HI}$" should read --voltage $V_{HI}$--.

UNITED STATES PATENT AND TRADEMARK OFFICE

CERTIFICATE OF CORRECTION

PATENT NO. : 4,736,223

DATED : April 5, 1988

INVENTOR(S) : KOJI SUZUKI, ET AL.

It is certified that error appears in the above-identified patent and that said Letters Patent is hereby corrected as shown below:

COLUMN 11

Line 44, "iof" should read --of--.

COLUMN 13

Line 47, "ffor" should --for--.

COLUMN 14

Line 44, "manufa-" should read --manufac- --.

COLUMN 15

Line 14, "photositive drum 1" should read --photosensitive drum 1--.

COLUMN 16

Line 41, "Other" should read --color--.

UNITED STATES PATENT AND TRADEMARK OFFICE

CERTIFICATE OF CORRECTION

PATENT NO. : 4,736,223

DATED : April 5, 1988

INVENTOR(S) : KOJI SUZUKI, ET AL.

It is certified that error appears in the above-identified patent and that said Letters Patent is hereby corrected as shown below:

COLUMN 18

Line 12, "control mans" should read --control means--.

Signed and Sealed this

Twenty-fifth Day of June, 1991

*Attest:*

*Attesting Officer*

HARRY F. MANBECK, JR.

*Commissioner of Patents and Trademarks*